US006286239B1

(12) United States Patent
Greenlees

(10) Patent No.: US 6,286,239 B1
(45) Date of Patent: Sep. 11, 2001

(54) DISPLAY SYSTEMS

(76) Inventor: Errol James Stewart Greenlees, Stone House Cottages, Stone, East Pennard, Shepton Mallet, Somerset, BA4 6RZ (GB)

( * ) Notice: Subject to any disclaimer, the term of this patent is extended or adjusted under 35 U.S.C. 154(b) by 0 days.

(21) Appl. No.: 09/380,613

(22) PCT Filed: Mar. 18, 1998

(86) PCT No.: PCT/GB98/00800

§ 371 Date: Sep. 16, 1999

§ 102(e) Date: Sep. 16, 1999

(87) PCT Pub. No.: WO98/41967

PCT Pub. Date: Sep. 24, 1998

(30) Foreign Application Priority Data

| | | |
|---|---|---|
| Mar. 18, 1997 | (GB) | 9705567 |
| Jul. 4, 1997 | (GB) | 9714065 |
| Aug. 6, 1997 | (GB) | 9716513 |
| Aug. 13, 1997 | (GB) | 9717048 |

(51) Int. Cl.[7] ..... G09F 19/00
(52) U.S. Cl. ..... 40/437; 40/476; 40/509
(58) Field of Search ..... 40/436, 437, 445, 40/476, 486, 488, 509

(56) References Cited

U.S. PATENT DOCUMENTS

| | | | | |
|---|---|---|---|---|
| 3,683,525 | * | 8/1972 | Fukui | 40/437 |
| 3,862,504 | * | 1/1975 | Ringelheim et al. | 40/476 X |
| 3,883,966 | | 5/1975 | Ludwig | 40/437 |
| 3,918,185 | | 11/1975 | Hasala | 40/437 X |
| 4,038,767 | | 8/1977 | Chasin et al. . | |
| 4,118,879 | | 10/1978 | Simon | 40/476 X |
| 4,246,713 | * | 1/1981 | Eckert | 40/476 X |
| 4,489,514 | | 12/1984 | Honse | 40/476 |
| 5,440,214 | * | 8/1995 | Peeters | 40/467 X |
| 5,459,954 | * | 10/1995 | Bronaugh et al. | 40/476 |

* cited by examiner

*Primary Examiner*—Brian K. Green
(74) *Attorney, Agent, or Firm*—Blank Rome Comisky & McCauley, LLP

(57) ABSTRACT

A poster display system for displaying a plurality of different images which includes an image grid with interlaced strips from the various images, masking grid adjacent the image grid having spaced apart masking strips alternating with spaced apart window strips, a mounting system for mounting the image grid and the masking grid for movement relative to one another, a drive mechanism for producing relative movement between the image grid and the masking grip between successive display positions in which the window strips of the masking grid are aligned with image strips of a particular image, the image strips of the other images being obscured by the masking strips, and compression means for urging opposite edge portions of the image grid and of the masking grip towards each other whereby the image grid and the masking grid become curved and the image grid and the masking grid are brought into intimate contact with one another under pressure.

17 Claims, 13 Drawing Sheets

6
2
19B
19A
19C
20B
1
23
22
4B
14
19B
18
20A
20C
12
8
17
15
III
III
7
31
13
2
5
3
1
4A 79
31
86
83
78
22
72
70
68
69
71
76
43
74
30
25
73
x
y
w
z
84
85
80
82
81
77
87

DISPLAY SYSTEMS

BACKGROUND OF THE INVENTION

1. Field of the Invention

This invention relates to poster display systems and to methods of displaying poster images.

2. Description of Related Art

It is often desired to display more than one poster image at a particular site and there already exist poster display systems in which the poster image is displayed on a series of juxtaposed elongate elements of polygonal cross-section. One face of each element carries a respective part of the poster image and the image displayed can be changed by rotating all of the elements in unison so that they each present another face. Such display systems involve the use of a multiplicity of polygonal elements each of which must be rotated during use of the systems and to each of which must be attached respective parts of each poster image. Thus the manufacture of such a system is expensive and the changing of the set-up of the system to enable a different set of poster images to be displayed is cumbersome and expensive.

It has been proposed to provide a poster display system for presenting a plurality of different images by mounting a masking sheet over a poster image sheet and moving the masking sheet small distances relative to the poster image sheet. The poster image sheet is formed with a multiplicity of image strips with adjacent strips defining portions of different images. The masking sheet has alternate opaque and transparent strips so as to reveal selected ones only of the poster image strips. In one position of the masking sheet relative to the image sheet, strips of a first image remain exposed while other image strips are concealed behind opaque strips of the masking sheet. In another position of the masking sheet relative to the image sheet strips of the first image are concealed behind opaque strips whilst the image strips relating to another image that were previously concealed behind the masking strips become exposed. Provided the width of the masking strips is not too great, a human eye will fill in the masked parts of the image and see an entire poster image. The image seen will, however, vary according to which image strips are exposed. Thus the display system may be used to display a plurality of unrelated static images, or a plurality of closely related images which, when displayed in the correct sequence, provide an animation, as for example proposed in U.S. Pat. No. 3,918,185.

For the proper functioning of a poster display system of the kind just described, in which image strips relating to a plurality of poster images are provided on a common poster image sheet, it is very important that the relative positions of the poster image sheet and the masking sheet are very precise. That requirement applies and is relatively simple to meet if only two images are included on the poster image sheet but is more onerous if more images are included. Furthermore, it is very desirable that it should be easy to replace one poster image sheet by another so that a different set of images can be displayed by the system. Further still, it is very important that the poster image sheet and the masking sheet maintain overall contact with each other between the surfaces of the composite material upon which the grids are printed.

SUMMARY OF THE INVENTION

Such requirements have proved very onerous and prevented widespread commercial use of such display systems.

According to the present invention there is provided a poster display system for displaying a plurality of different images, the system comprising (a) an image grid carrying a first set of image strips comprising a multiplicity of first strips spaced apart from one another and presenting different regions of a first image, and a second set of image strips comprising a multiplicity of second strips spaced apart from one another and presenting different regions of a second image, said second strips being distributed over the grid between the said first strips;

(b) a masking grid adjacent to the image grid and carrying a set of masking strips comprising a multiplicity of masking strips spaced apart from one another and a set of window strips comprising a multiplicity of window strips spaced apart from one another, said window strips being distributed over the grid between said masking strips;

(c) a mounting system for mounting the image grid and the masking grid for movement relative to one another;

(d) drive means for producing relative movement between the image grid and the masking grid between a first display position, in which said window strips are aligned with said first image strips and said second image strips are obscured by said masking strips, and a second display position, in which said window strips are aligned with said second image strips and said first image strips are obscured by said masking strips; and (e) compression means for urging opposite edge portions of the image grid and of the masking grid towards each other whereby the image grid and the masking grid become curved and the image grid and the masking grid are brought into intimate contact with one another under pressure.

The use of further compression of the image grid or the masking grid enables them to be brought into close proximity as a result of the substantially complete exclusion of air between these grids, and this can result in particularly good registration of the window strips of the masking grid with image strips of the image grid, thereby enabling only image strips of one image and no other to be viewed at a time.

The image grid preferably carries three or more sets of image strips. It is then possible to have three or more images displayed sequentially by the system. The more sets of image strips that are provided, the greater the width required for the masking strips relative to the image strips. As a result, accurate mounting of the masking strips relative to the image strips, which can be facilitated by the present invention, becomes more advantageous.

Using a masking grid having masking strips alternating with window strips, the width of each window strip may be less than one fifth of the width of adjacent masking strips and a good image can still be displayed. It is advantageous that the masking strips between adjacent window strips have widths of less than about 2 mm so that the images appear continuous to the eye.

The width of each window strip is preferably less than the width of each image strip with the respective window strip is aligned. Such extra width of image strip provides a small tolerance for the relative positions of the window strips and image strips, and it also allows for oblique viewing of the display.

Although the image grid may form one face of a rigid body of substantial thickness, it is preferably formed on a flexible sheet which advantageously has a thickness of less than 1 mm and more particularly of less than 0.5 mm. The image strips are preferably printed on the image grid.

The masking grid should at least be translucent and preferably transparent. It is also preferred that the masking strips be printed on the masking grid. Forming the image strips and the masking strips by printing is very simple and modern printers can print such strips with sufficient accuracy.

The masking grid and the image grid are preferably made from the same material so that they will expand and contract in a similar way in response to temperature changes and the like. These two grids preferably have a low coefficient of expansion.

It is generally preferred to arrange the image grid and the masking grid with their respective printed faces immediately adjacent to each other as this can enable the accuracy of positioning the image strips and the masking strips to be improved and problems caused by oblique viewing can be reduced.

Whilst it is possible to have an intermediate translucent sheet or sheets between or laminated to the image grid and the masking grid, it is preferable to have these grids in direct contact with one another with substantially no air between them. The exclusion of air from between the grids not only enables them to be brought into contact with one another, it also tends to keep them in contact with one another since the grids can only separate as a result of air entering between them at their edges. If one or both grids are laminated with a laminating film to protect the ink used to print the respective grids, the lamination film is preferably not more than 13 $\mu$m thick.

In addition to using compression to bring the image grid and the masking grid into intimate contact, systems in accordance with the present invention can include additional means for increasing such contact. Electrically charging one of the grids is a particularly suitable method of achieving this. Employing the inherent static properties of the image and masking grids to attract one grid to the other is another such means.

Systems in accordance with the present invention preferably include adjustment means for setting up the relative positions of the image grid and the masking grid in a first display position. Such adjustment means preferably allow an operator to carry out fine adjustment of the relative positions of these grids after the installation of a new image grid, and it is preferred to use a screw-threaded adjuster element to effect such adjustment.

The adjustment means preferably includes means for altering the positions of a drive member for moving the moveable grid, and the drive means by which it is driven, relative to a member to which the static member is fixed. The drive member may be a rotatable cam which is preferably detachable without dismantling the display unit, it being particularly convenient to be able to change the cam and the grids without dismantling the whole system. Thus the position of the axis of rotation of the cam is preferably adjustable using adjustment means.

The material from which the image grid and/or the masking grid are made can also be significant. Preferably they are of a plastics material and more preferably polyethylene terephthalate or a polycarbonate. An especially preferred material is sold under the trade mark Melinex, the grade Melinex 506 being used in the specific embodiments of display systems in accordance with the present invention which are described herein.

Systems in accordance with the present invention preferably include means for lighting the image grid from behind both the image grid and the masking grid and this can be provided by providing a pathway for natural light and/or at least one artificial light source.

It might be thought that the masking grid would have to be in front of the image grid, but we have found that these grids can be mounted either way around, it being preferred to use back lighting when the image grid is nearest to the viewer. The mounting arrangement can, therefore, enable the two grids to be mounted with either in front. However, it is especially preferred to use a mounting arrangement for detachably mounting the image grid in front of the masking grid when the curve of the grids is concave as seen by a viewer, but behind the masking grid when the curve of the grids is convex as seen by the viewer. Replacement of the image grid can then be relatively simple.

The drive means can be attached to either the masking grid or to the image grid. The grid not so attached remains static.

It has been found that by curving the image grid and the masking grid, the retention of overall contact between the two adjacent faces of these grids can be greatly improved. Such a curve can be achieved by fixing a clear base panel, made of the same or similar material, and of the same or similar thickness as that of the image grid and the masking grid, along two opposite edges within a display housing to an angled section using clamping bars of an appropriate material. The clear base panel can then be fixed so that it forms a natural curve when the display housing is laid horizontally on its back.

When in this position, the lowest part of the curve formed by the clear base panel can, for example, be between 5 and 50 mm lower than its fixed edges. Once the base panel has been fixed in position, for example using clamping bars, adjustable compression bars of an appropriate material can then be positioned between the two clamping bars. A secondary clear panel can then be positioned between the two compression bars.

The curved width of the secondary clear panel is preferably a few millimeters less than the curved distance between the two compression bars when these two bars are fully adjusted away from each other. However, the curved width of the secondary clear panel is wider than the curved distance between the two compression bars when they are fully adjusted towards each other. The compression bars can therefore be adjusted to meet the corresponding and parallel edges of the secondary clear panel and then further squeezed together providing a compressive force upon the secondary clear panel forcing it into the curve of the clear base panel. In this manner, the curved clear base panel and the curved secondary clear panel become sufficiently rigid to retain a coherent curve when the display housing is raised into an upright and vertical position.

The masking grid, which has a width which is less than the curved distance between the compression bars and thereby allowing lateral registration of the masking grid in relation to the image grid, is placed over the secondary clear panel and fixed to this panel by adhesion or by the use of bolts along its top or bottom edge through the secondary clear panel to the clear base panel.

The image grid, which also has a width which is less than the curved distance between the compression bars but is greater than the width of the masking grid, is placed over the curved masking grid and it is attached to a mechanism for moving it up and down relative to the masking grid. Lateral registration of the image grid relative to the masking grid can then be achieved using off-set cams positioned either side of the image grid towards the edge of the image grid furthest away from the mechanism. These cams can then be rotated and fixed in position touching opposite side edges of the image grid once the latter has been laterally registered with the masking grid. Vertical registration of the image grid relative to the masking grid using the mechanism has been previously described.

If desired, the image grid and the masking grid can be interchanged so that the masking grid is in front of the image grid. In such a case, the image grid is preferably fixed to the secondary clear panel or through this panel to the base panel, and the masking grid is then positioned between the off-set cams and fixed to the drive mechanism.

If desired, a front sheet of a clear material can be placed tightly between the compression bars and fixed through the static grid and the secondary clear panel to the clear base panel. The height of the moveable grid is then preferably sufficiently less than that of either the clear panels or the static grid to avoid the fixings of the clear panels and the static grid.

If a separate diffusion panel is not incorporated into the display housing to diffuse light from lamps, either of the clear panels behind the grids or the rear grid itself can be made from a semi-opaque material.

The compression bars can be used in place of the cams to achieve lateral registration of the grids though this generally requires very accurate cutting of whichever is the moveable grid.

If required, illumination for the display can be positioned on the concave or the convex side of the curved clear panels and grids with the display unit being viewed from the other side of the curved clear panels or grids.

If required, the drive mechanism can be fixed to the top panel of the display housing, or to the base panel of the display housing. When the drive mechanism is attached to a side panel of the display housing, so that the compression bars are at the top and the bottom of the display housing, a solid bar of clear material should in general be fixed tightly between the compression bars in front of the concave curve of the clear panels and grids so that this solid bar bends to match the curve of the clear panels and grids. Such a bar should be placed between both ends of the compression bars, and thus two such bars should be used.

If required, whichever grid is placed over the secondary clear panel can itself be attached to the protruding stud on the drive mechanism, thereby becoming the moveable grid. The grid placed over the moveable grid then becomes the static grid which is attached to the clear base panel through the secondary clear panel.

Whichever grid is the moveable grid, it should in general be wider than the static grid to allow retention of registration if off-set cams are used to act on the moveable grid.

If required, either grid can be placed directly on to the clear base panel and the secondary clear panel can then be omitted, and indeed the clear front panel can also be omitted. Furthermore, the static grid can replace the clear base panel, and the secondary clear panel can be replaced by the moveable grid. Thus if the clear front panel is also omitted, only the image and masking grids would form the semi-rigid viewing area. In this latter case, the moveable grid would need to be cut very accurately as the compression bars become the means of keeping the moveable grid in linear registration with the static grid.

To overcome friction between the moveable grid and the compression bars, which would require greater torque from the drive motor, the compression bars can be attached directly to the moveable grid. Compression can then be applied directly to the compression bars, for example using off-set cams or adjustable circular bearings attached to the angled section. These off-set cams or adjustable bearings can also be used to effect linear registration between the image grid and the masking grid.

If the images made up of image strips on the image grid making up the respective images differ from each other only slightly, it is generally unnecessary for the image strips of the image grid to be wider than the transparent strips of the masking grid in order to achieve a smooth visual sense of animation of the image, especially if the grids are moved fairly rapidly relative to each other. In addition, when the image strips of the image grid and the transparent strips of the masking grid are of substantially the same width, the number of image strips that can be displayed, for example in an animation, can be increased compared to arrangements where the image strips are wider than the transparent strips because the number of image strips masked by each masking strip of the masking grid can thereby be increased. As will be appreciated, the more images that make up an animated sequence the smoother and longer an animated sequence can be. However, if the image strips are narrower than the width of the transparent strips, the animation effect will usually appear blurred.

By way of example, the opaque strips on a masking grid of A2 size can be at least 2.00 mm with the image strips and the transparent strips of the masking grid each being as narrow as 0.10 mm. It is then possible to provide an animated sequence of twenty images, each image varying slightly from its adjacent images, by obscuring nineteen consecutive sets of image strips using masking strips on the masking grid which are 1.90 mm wide. The twentieth image strip is then visible from behind or in front of the transparent strips of the masking grid.

In some instances it might be desirable to dwell for a longer period of time on, say, the final image of an animated sequence, in which case the last two image strips of each set of image strips can be identical or can have a width greater than the window strip. Cams controlling movement of the moveable grid will in general need to be adapted accordingly. For example, if each image is displayed through the masking grid for 0.25 seconds, the whole animated sequence from the first to the twentieth and back to the first image would last for 10 seconds, i.e. a total of forty images times 0.25 seconds per image. In this manner, an animated display can be achieved, for example a bird in flight or advertising graphics that appear at first to be moving away from the viewer and then towards them.

As the size of the masking grid and the image grid is increased, the widths of the opaque strips on the masking grid can often be increased as the viewing distance increases. However, the width of the image strips on the masking grid do not necessarily have to be increased in the same proportion, and the number of image strips that make up an animation sequence can thereby be increased as a result of using wider masking strips.

Embodiments of display system in accordance with the present invention will now be described by way of example with reference to the accompanying diagrammatic drawings.

BRIEF DESCRIPTION OF THE FIGURES OF DRAWINGS

DETAILED DESCRIPTION OF THE PREFERRED EMBODIMENT

Figure 1:
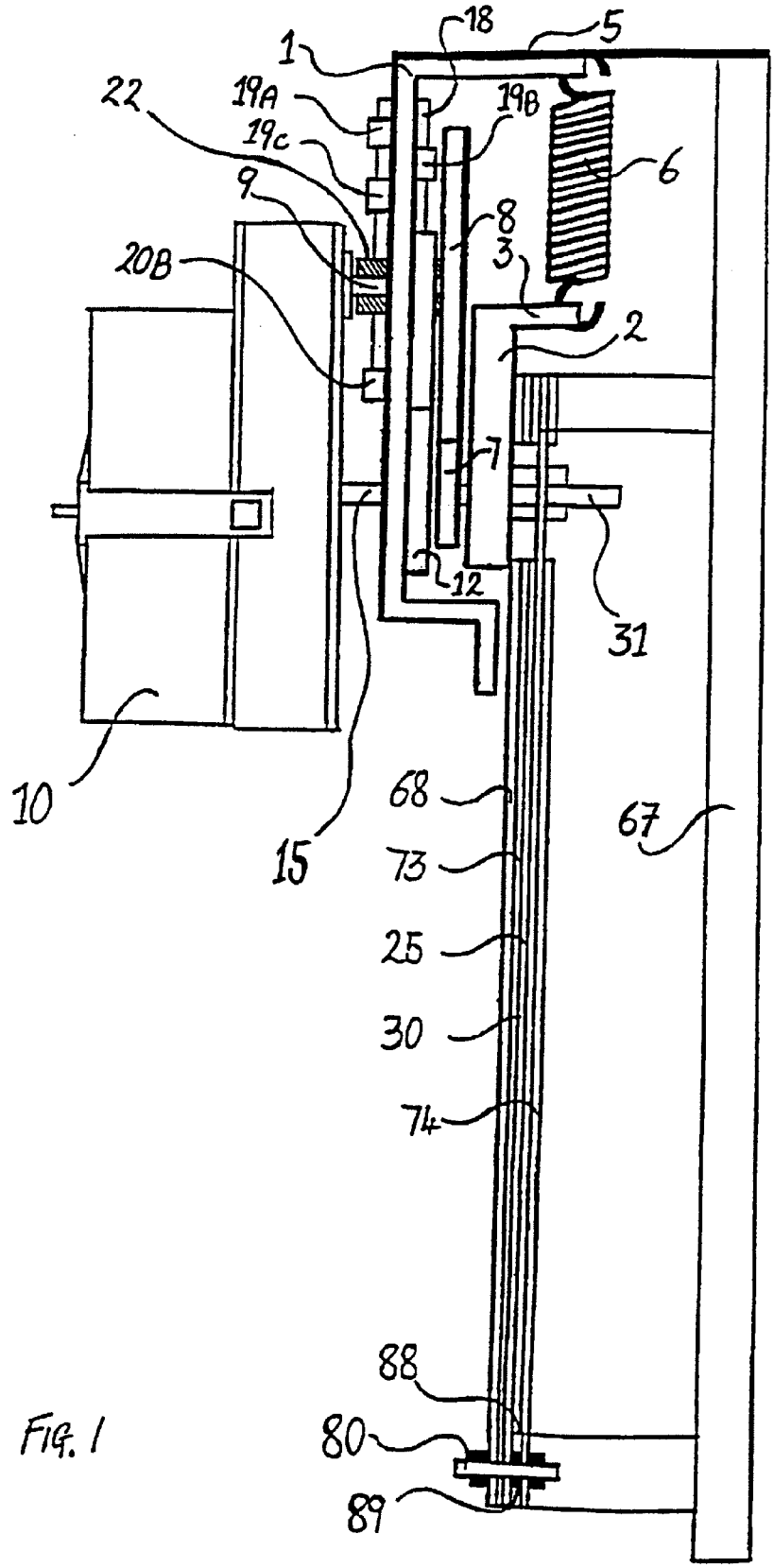
FIG. 1 is a sectional side view of a mechanism for effecting relative movement between the image grid and the masking grid of a first embodiment of system of the present invention.
Figures 2, 3:
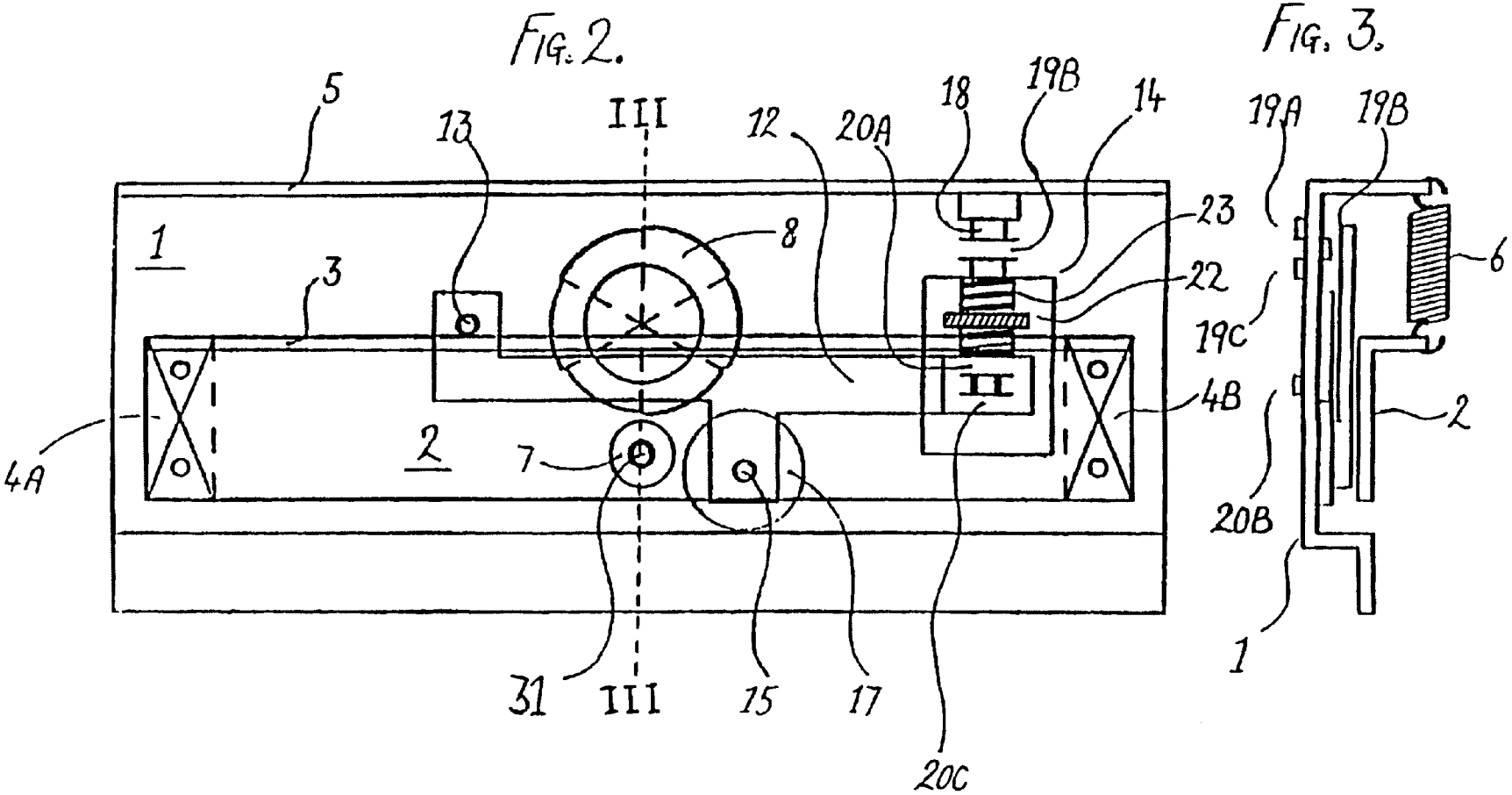
FIG. 2 is a front view of the mechanism of FIG. 1.
FIG. 3 is a sectional view along line III—III of FIG. 2.

Referring to FIGS. 1 to 3, a drive mechanism is shown which has a fixed rear plate 1 and a front plate 2 movably mounted on the rear plate 1. The front plate 2 has a horizontal, forwardly projecting, top flange 3 and it is secured on each side using slide bearings 4A and 4B in a manner (not shown in detail in the drawings) which facilitates precise vertical sliding of the plate 2 relative to the rear plate 1. The rear plate 1 has a horizontal, forwardly projecting top flange 5 which extends over the front plate 2 and a tension spring 6 (shown in FIG. 1) is connected between the plates 1 and 2, thereby biasing the front plate 2 upwardly. A bearing roller 7 is mounted on the rear of the front plate 2 and it is biased upwardly by the spring 6 into contact with a rotatable cam 8 in front of the rear plate 1. The cam 8 limits upward movement of the plate 2 and it thus defines the position of the front plate 2 relative to the rear plate 1. A stud 31 projects forward of the plate 2.

The cam 8 is mounted on an output shaft 9 of a motor 10 which incorporates as a unit a motor and reduction gearing. Rather than mounting the motor 10 directly on the rear plate 1, it is mounted in a position that is finely adjustable relative to the rear plate 1 as will now be described.

An adjustable arm 12 is pivotally mounted at one end by a pivot 13 to the rear plate 1 and it is finely adjustable at the other end by an adjusting mechanism 14 which, when operated, causes limited pivotal movement of the arm 12 about the pivot 13. The motor 10 has two mountings, the first being pivotal on the rear plate 1 coincident with the pivot 13, and the second being on a rod 15 which is behind the rear plate 1 and the arm 12. The adjusting mechanism 14 causes limited pivotal movement of the arm 12 about the pivot 13 and, when it does so, it imparts the same pivotal movement to the motor 10 thereby causing the shaft 9 on which the cam 8 is mounted to move about the pivot 13. Since the shaft 9 is at substantially the same vertical level as the pivot 13, the arcuate movement of the shaft 9 and the cam 8 is effectively vertical for small amounts of pivoting. An opening 17 in the rear plate 1 provides the necessary freedom of movement for the rod 15 to move relative to the plate 1.

The adjusting mechanism 14 consists of a vertical shaft 18 connected at an upper end to the rear plate 1 and at a lower end to the arm 12 as will now be described more fully.

In the region of the shaft 18, the rear plate 1 is partially cut away and portions 19A, 19B and 19C are bent out of the plane of the plate 1, portions 19A and 19C projecting rearwardly and portion 19B projects forwardly (see FIG. 3). The upper end of the shaft 18 (not shown in FIG. 2) passes in front of the portions 19A and 19C and to the rear of the portion 19B, it being screw-threadedly in those portions. In the region where the arm 12 is connected to the lower end of the shaft 18 it is similarly formed with bent portions 20A and 20C which project forwards and portion 20B which projects backwards. The lower end of the shaft 18 passes behind the portions 20A and 20C and in front of portion 20B, the shaft 18 being rotatably mounted in the portions without any axial movement. A knurled disc 22 fixed to the shaft 18 midway along its length enables a user to rotate the shaft 18, and compression springs 23 on each side of the knurled disc 22 between the disc 22 and the portions 19C and 20A respectively prevent the shaft 18 from rotating except when the disc 22 is positively moved by the user.

When the shaft 18 is rotated, the screw-threaded engagement of the shaft with the portions 19A, 19B and 19C of the rear plate 1 causes the shaft 18 to move axially relative to the rear plate 1 thereby moving the end of the arm 12 to which the shaft 1 is connected in a substantially vertical direction to pivot the arm 12 about the pivot 13.

Figure 4:
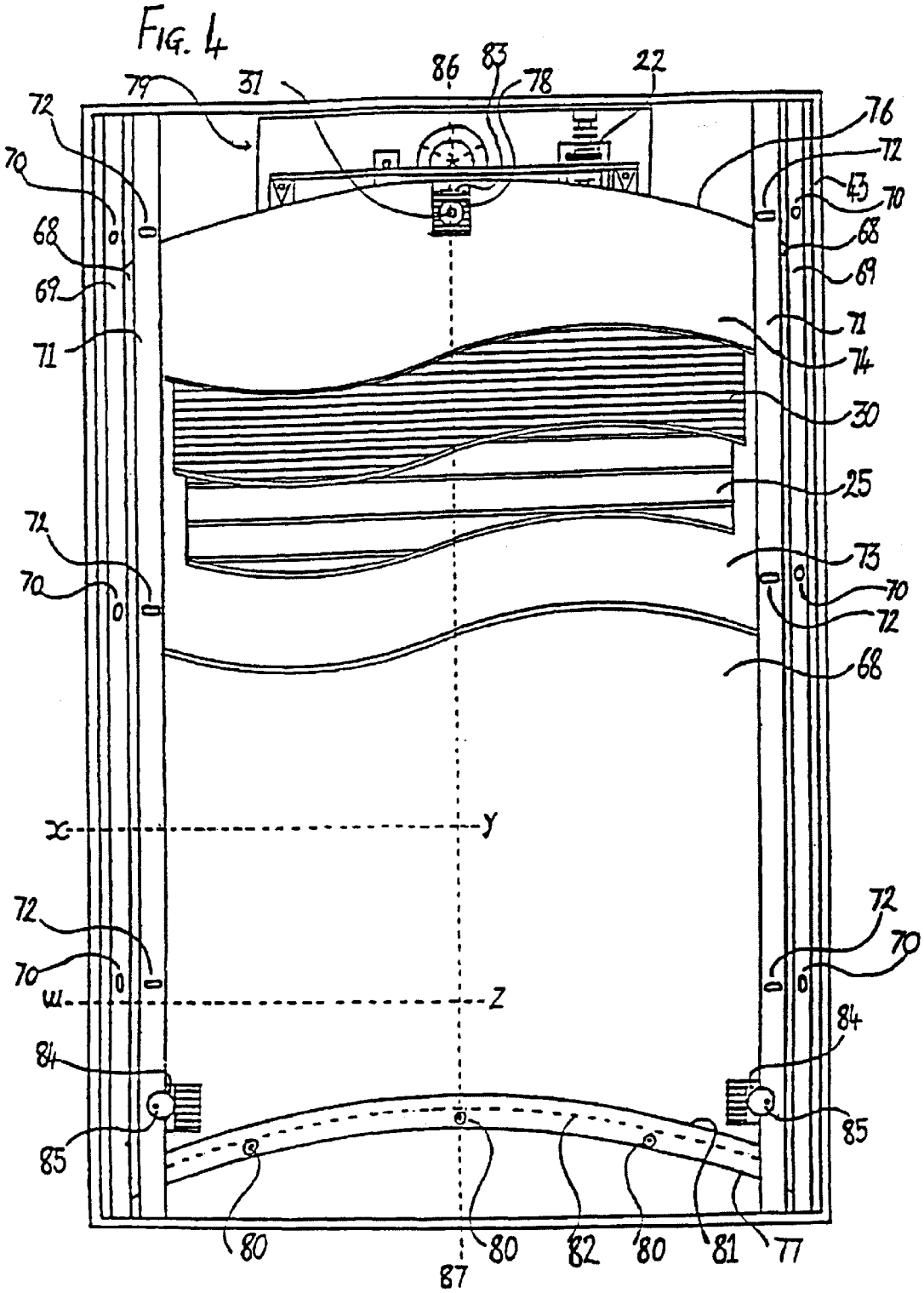
FIG. 4 is a partially cut away view of a first embodiment of system in accordance with the present invention.
Figure 5:
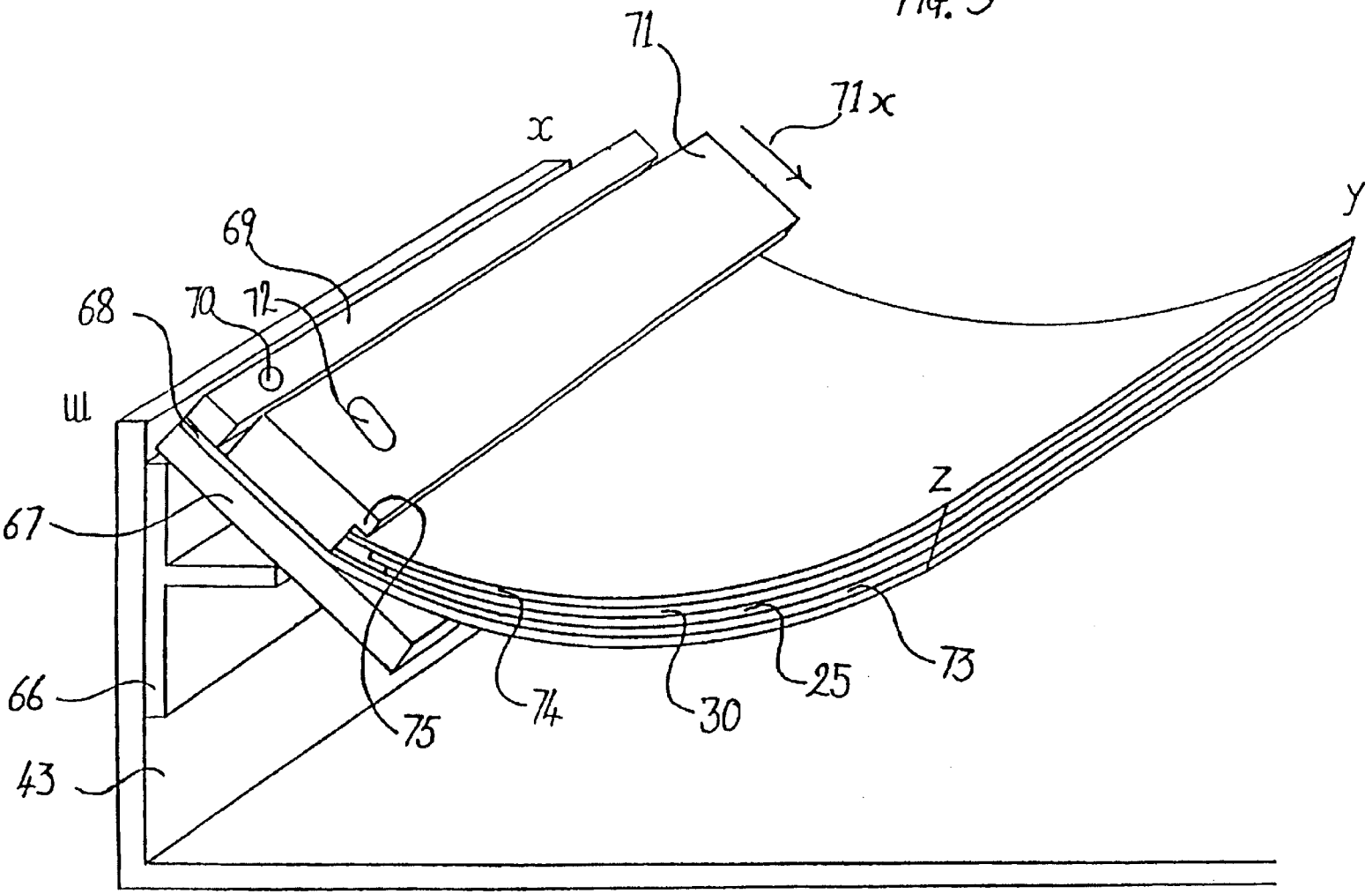
FIG. 5 is a perspective view, to an enlarged scale, of the portion of FIG. 4 defined by the broken lines X-Y and W-Z.

Referring to FIG. 4, clamping bars 69 and adjustable compression bars 71 within the display housing 43 are attached to the angled section 67 (see FIG. 5). A clear base panel 68 is located under the compression bars 71 and it is fixed to the angled section 67 by clamping bars 69. The arrangement of a front clear panel 74, an image grid 30, a masking grid 25 and a secondary clear panel 73 laid over the clear base panel 68 can also be seen.

All of the clear panels 68, 73, 74 and the masking grid 25 are cut to the same length, this being indicated by lines 76 and 77, and they each have a slot 78 cut out of them to allow for movement of the single central stud 31 which projects forwards from the mechanism 79 and to which the image grid 30 is attached.

The image grid 30 is shorter than the clear panels 68, 73, 74 and the masking grid 25 to ensure that as the image grid 30 is moved up and down it is not blocked by fixings 80 that pass through the clear base panel 68, the secondary clear panel 73, the masking grid 25, and the clear front panel 74 to hold the masking grid 25 in position between the secondary clear panel 73 and the moveable image grid 30. Lines 76 and 81 indicate the top and bottom of the image grid 30 when in its highest position, and the broken lines 82 and 83 indicate its lowest position.

Lower side slots 84 cut from the front clear panel 74 allow off-set cams 85 fixed to the compression bars 71 to be swivelled to touch the sides of the image grid 30 and to keep the image grid 30 in lateral registration with the masking grid 25. Vertical registration between the two grids 25 and 30 is effected by the adjuster 22 forming part of the mechanism 79 which has previously been described.

FIG. 1 is a side view corresponding to that of FIG. 4 along broken line 86-87 of FIG. 4, FIG. 1 showing the angled section 67 (see FIG. 5) and the relative positions of the clear base panel 68, the secondary clear panel 73, the masking grid 25, and the clear front panel 74, plus the image grid fixed to the stud 31, the image grid being sandwiched between the masking grid 25 and the clear front panel 74. Also shown is how a fixing 80 passes through the clear base panel 68, the secondary clear panel 73, the masking grid 25 and the clear front panel 74 to fix the masking grid 25 in position.

As can also be seen from FIG. 1, the image grid 30 is cut shorter at a point 88 so that it is not blocked by the fixing 80 when the image grid 30 is moved up and down. A spacer 89 between the masking grid 25 and the front clear panel 74 allows free movement of the image grid 30.

When the masking grid 25 and the image grid 30 form the semi-rigid viewing area, registration between these grids can be facilitated by retaining the compression bars so that they act on the moveable grid. Linear registration can then be achieved by adjusting the compression bars to ensure that the image strips on the image grid 30 are parallel to the strips on the masking grid 25 whilst applying sufficient compression to ensure total overall contact between the respective grids.

Referring to FIG. 5, a "T" section bar 66 is attached to the interior of the display housing 43 to allow the angled section 67 to be set in position. The clear base panel 68 is attached to the angled section 67 by a clamping bar 69 and also to an opposing angled section (not shown) by bolts passing through apertures 70 (see FIG. 4). An adjustable compression bar 71 is positioned on the clear base panel 68 and it is held lightly in place by bolts which pass through apertures 72 (see FIG. 4) in the compression bars 71 and they screw into the angled section 67 through the clear base panel 68.

The secondary clear panel 73 is placed on the clear base panel 68, and the adjustable compression bar 71 is pushed downwardly and inwardly as indicated by the arrow 71*x* so that the secondary clear panel 73 is compressed between the adjustable compression bar 71 and the opposing adjustable compression (not shown). The bolts passing through the apertures 72 are then tightened to secure the adjustable clamping bars 71 in position.

Figure 6:
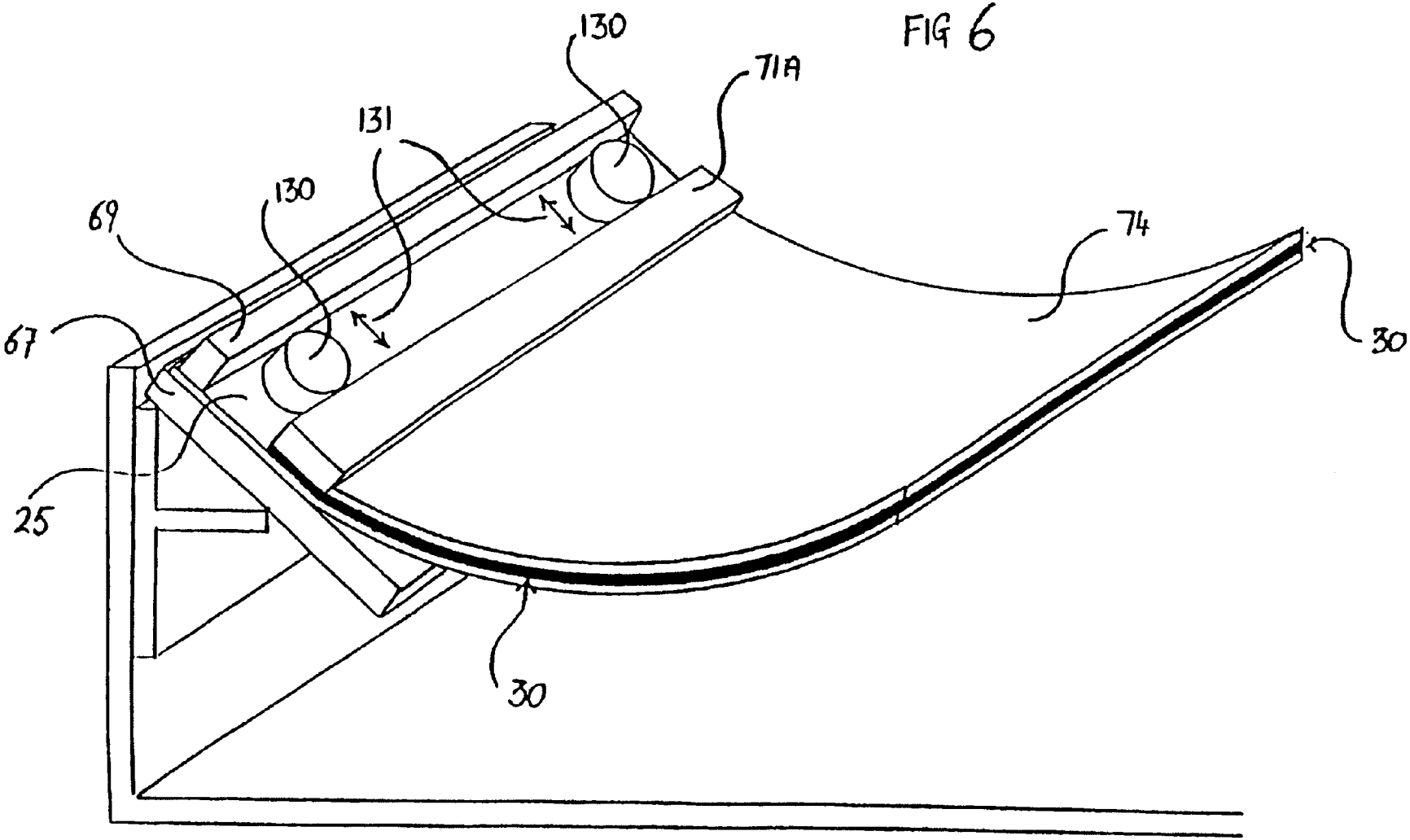
FIG. 6 is a similar view to that of FIG. 5 of a second embodiment having different compression means.

FIG. 6, which is similar to FIG. 5, shows the static grid, in this case the masking grid 25, attached to an angled section 67 by the clamping bar 69 in a similar manner to that described with reference to FIG. 5. Circular adjustable bearings 130 which can be adjustably fixed towards or away from the clamping bar 69, as indicated by arrows 131, act upon the compression bar 71A which is attached directly to the movable grid, in this case the image grid, 30 to compress the moveable grid 30 into overall contact with the static grid 25. By adjusting the circular bearings 130, appropriate linear registration can also be achieved between the two grids. If required, a clear sheet 74 can be positioned between the compression bars 71A to protect the moveable grid 30.

As the compressive force is increased to keep the grids together, so the static quality of the material used to make the grids tends to become of less value as an additional means of maintaining overall contact between the grids.

If required, the off-set cams or the circular bearings 130 can be used to exert a compressive force directly to the moveable grid 30 to keep it in contact with the static grid 25. In such a case, the compression bars are usually unnecessary. Also in such cases it can be more desirable to effect parallel registration between the two grids by attaching a single bracket to the moveable grid, this bracket being adjustably attached to another bracket or block attached to a slideable plate of the mechanism for moving the associated grid. The bracket attached to the slideable plate is then preferably attached at as great a distance as possible from the protruding stud to which the moveable grid is attached. The moveable grid can then be attached to the protruding stud on the slideable plate using circular bearings to allow the moveable grid to swivel at the point at which the moveable grid is attached to the protruding stud. If required, the static grid can be sandwiched between a clamped clear or semi-opaque sheet and the moveable grid to which the compressive force is applied.

Figure 7:
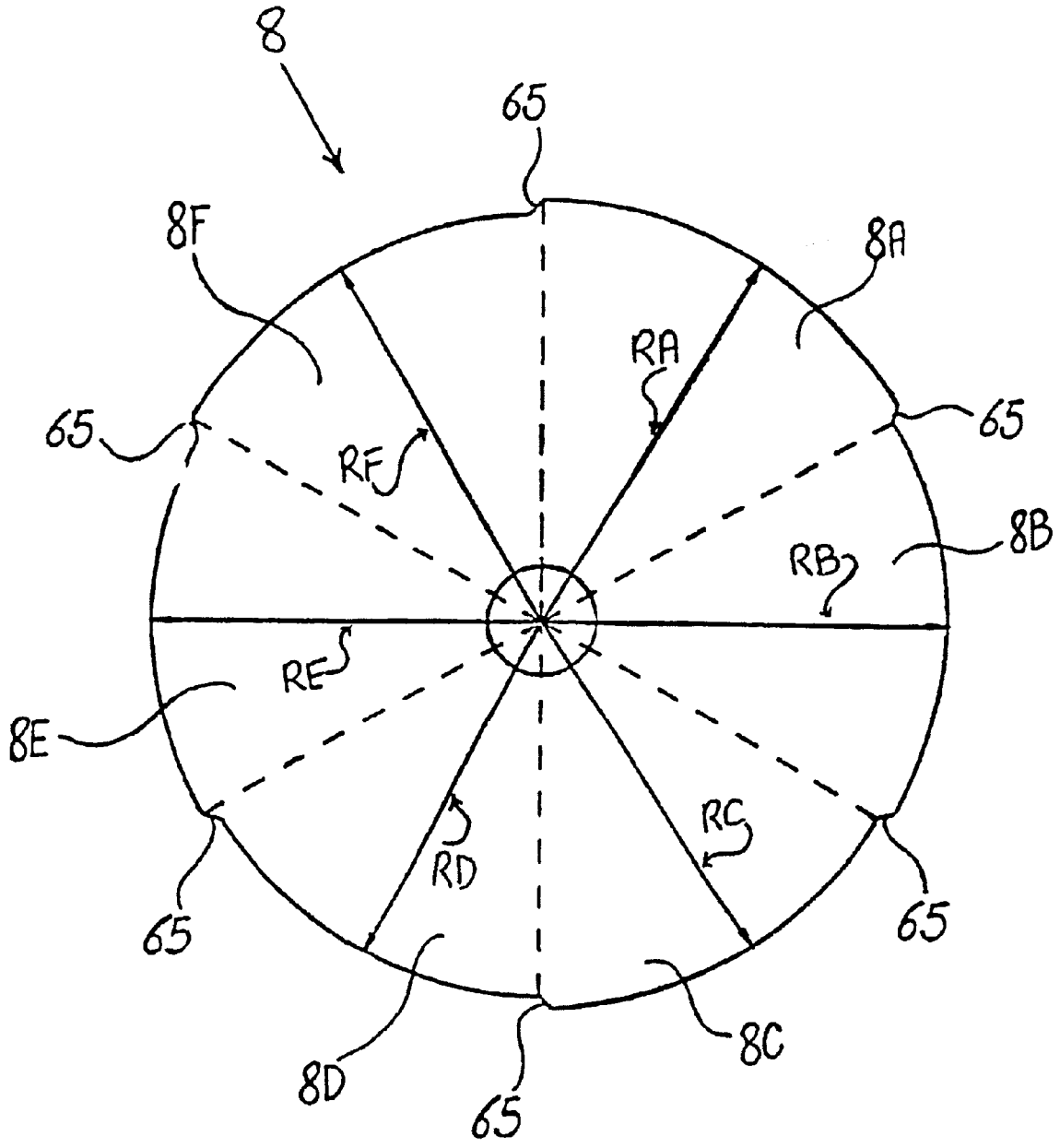
FIG. 7 shows the cam used with the embodiments described with reference to the preceding FIGS.

The cam used in the embodiments of FIGS. 1 to 6 is shown in FIG. 7, and, as can be seen, the periphery of the cam 8 is divided into a plurality of arcuate portions 8A to 8F, each defining an arc of a circle centered on the axis or rotation of the cam 8 and having a radius $R_A$ to $R_F$. At the junction between adjacent arcs are inclined ramps 65. There are six arcuate portions shown in FIG. 7, but particular image grids and masking grids may have different numbers of arcuate portions, for example eight sets of arcuate portions with four sets of image strips.

During use of the illustrated display systems, the cam 8 is rotated by the motor 10 and, as it rotates, the bearing roller 7 rests against and remains in contact with the bottom of the peripheral surface of the cam 8 due to the bias of the spring 6. The vertical position of the roller 7 is then determined by the radius of whichever portion 8A to 8F of the cam periphery is in contact with the bottom of the cam 8, and the difference in radius between adjacent cam portions corresponds to the center-to-center spacing of adjacent image strips as shown, for example in FIGS. 8A and 8B.

An effect of one image fading into another can be achieved by reducing the incline or increasing the decline of the steps 65.

The cam 8 shown in FIG. 7 will result in the images changing almost immediately and then remain for a given length of time. However, if the inclination of the steps 65 is considerably decreased and the declination of the steps 65 is considerably increased, for example so that the steps 65 are about one third of the lengths of the arcs 8A–8F, the images displayed will appear to fade into the next which will then appear for a shorter period of time.

Figure 8A:
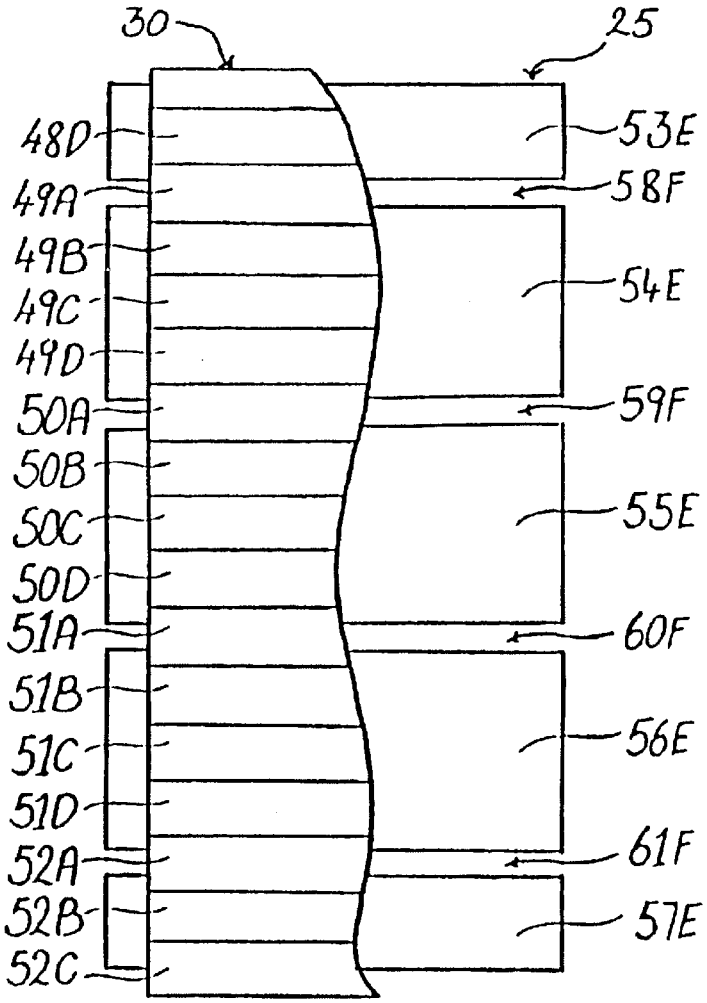
FIG. 8A shows a cut away portion of an image grid positioned over a masking grid.

FIG. 8A shows a cut away view of an image grid 30 positioned over a masking grid 25 in a system as described with reference to the preceding drawings. If these two grids are set up with this relative disposition with the roller on one of the portions 8A to 8F, rotation of the cam 8 of FIG. 7 through one eighth of a revolution will result in the roller 7 moving exactly the distance required to move the image grid 30 relative to the masking grid 25 by the exact width of one of the image strips, image strips 49B, 50B, 51B and 52B then becoming aligned with window strips 58F, 59F, 60F and 61F respectively.

Since movement of the roller 7 takes place in steps rather than gradually as it rolls over successive inclined ramps 65, the image grid is moved accordingly.

Using a cam 8 with six arcuate portions 8A to 8F which form two groups of three, the first three in turn increasing in radius and the second three in turn decreasing in radius, if the cam 8 revolves in a clockwise sense, the image grid 30, will first be moved by three steps downwardly from the first image visible through the masking grid as the cam 8 is rotated, and then three steps upwardly as it completes a revolution back to the first image. Each step brings the next of the four sets of image strips into alignment with the window strips 58F, 59F, 60F and 61F of the masking grid 25, and it then reverses the sequence, by which time the cam 8 has completed a single revolution.

As will be appreciated, the cam 8 can be rotated continuously at a constant rotational speed and the individual strips of the image grid 30 will then be viewed for the time taken for the cam to effect approximately one eighth of a rotation of the cam 8.

If it is desired to display one of the images on the grid 25 for a longer period than the others, the cam 8 can be provided with a longer arcuate portion so that the roller 7 remains in contact with the cam 8 for a longer period of time with that portion than on others. In such cases it is generally preferred to have diagonally opposite long arcuate portions.

A viewer of the display is usually unaware of the way in which the image grid 30 is moved relative to the masking grid 25, the viewer simply seeing a first image which, as the bearing roller 7 passes over one of the inclined ramps 65, changes smoothly into a second image, and so on.

It is, of course, desirable that the masking strips 53E to 57E are not too thick as this could adversely affect the resolution of the display. However, masking strips with a width of up to about 1.5 mm are generally satisfactory, but a noticeable reduction in resolution can be observed if the width of these strips is much wider than this. By way of example, the masking strips 53E to 57E can be 1.4 mm wide with the image strips being 0.2 mm wide, the center-to center spacing of the masking strips being 1.6 mm with that of the image strips being 0.4 mm. 12.5% of the image is then displayed through the window strips. In this case, the cam 8 will have adjacent arcuate portions 8A to 8F which differ in radius by 0.4 mm.

In the case just described, the image strips are twice as wide as the window strips, only one half of each image strip therefore being displayed. However, even in this case, the overlap of the image strips by the opposing edges of the windows in the masking grid is still only 0.1 mm which can be regarded as the tolerance in positioning the respective strips relative to each other. The image grid and the masking grid therefore need to be printed, positioned and moved very accurately. It will also be appreciated that any separation of the masking grid from the image grid of even less than 0.1 mm can have a markedly adverse effect on the performance of the system, and especially when the systems are viewed other than from directly in front.

Although FIG. 8A shows only relatively few image strips and masking strips, it will be appreciated that in practice a multiplicity of strips will be used. For example, the display area can be up to 0.7 m wide or more and up to 1.0 m high or more, and it is obviously important that the image grid and the masking grid be maintained in contact with each other throughout this area and that differences in expansion between these grids is kept to a minimum.

Figure 8B:
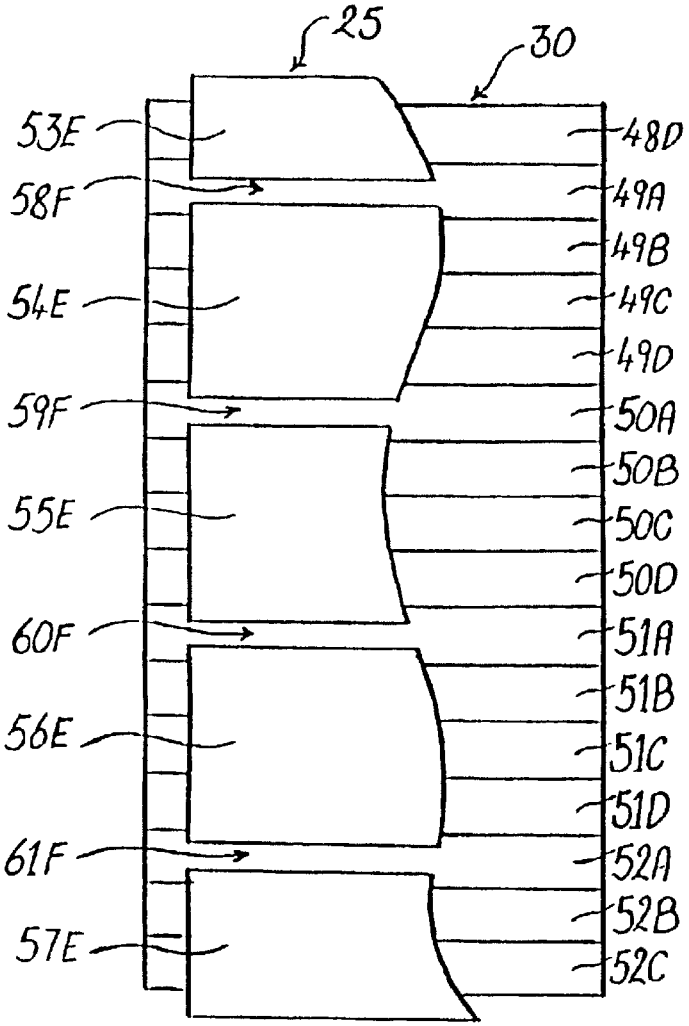
FIG. 8B shows a similar view to that of FIG. 8A but with the masking grid over the image grid.

The arrangement of grids shown in FIG. 8B is substantially the same as that described with reference to FIG. 8A, but the masking grid 25 is in this case on top of the image grid 30.

As will also be appreciated, it is possible to move the image grid and to keep the masking grid stationary or to move the masking grid and keep the image grid stationary, and in either case, the image grid can be behind or in front of the masking grid.

While the embodiments described above use vertical movement of one grid relative to the other, it will be appreciated that the grids can be moved relative to each other horizontally or in a sideways direction. In a yet further alternative, the relative motion between the grids can be in a vertical direction, but with a drive mechanism below the grids rather than above them.

Figure 9:
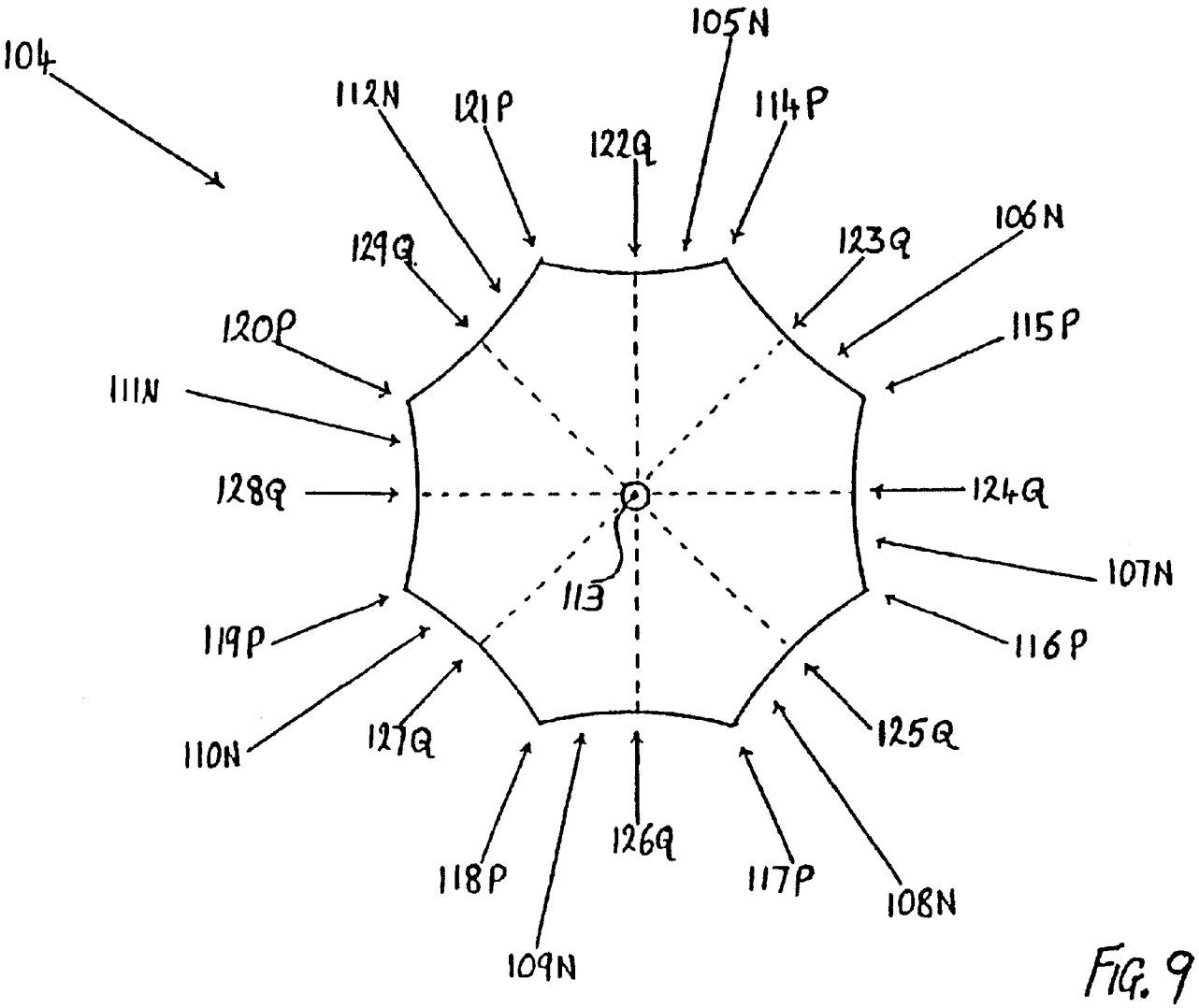
FIG. 9 shows an alternative form of cam.

FIG. 9 shows an alternative eight sided cam 104 having eight arcuate cam surfaces 105N to 112N which subtend equal angles to and are convex towards its center. The respective ends 114P to 121P of the arcs 105N to 112N are each 2.00 mm further away from the center 113 than are the centers 112Q to 129Q of the surfaces 105N to 112N. Thus when cam 104 is used in place of the cam 8 described in relation to FIG. 7, the masking grid 25A or the image grid 30A (see FIGS. 10A and 10B) controlled by the mechanism in the manner described in relation to FIGS. 1 to 3 is moved 2.00 mm down and then 2.00 mm up as the periphery of the cam 104 moves in a clockwise sense over the bearing 7 of the mechanism 79 from position 126Q to 117P and then on to position 125Q.

Further rotation of the cam 104 results in the bearing 7 being forced downwardly again to arc end 116P, and so on. In this manner, as cam 104 rotates by one eighth of a revolution, the masking grid 25A or the image grid 30A are moved by rotation of the cam 104 and will at first fall 2.00 mm and then rise by 2.00 mm.

Figure 10B:
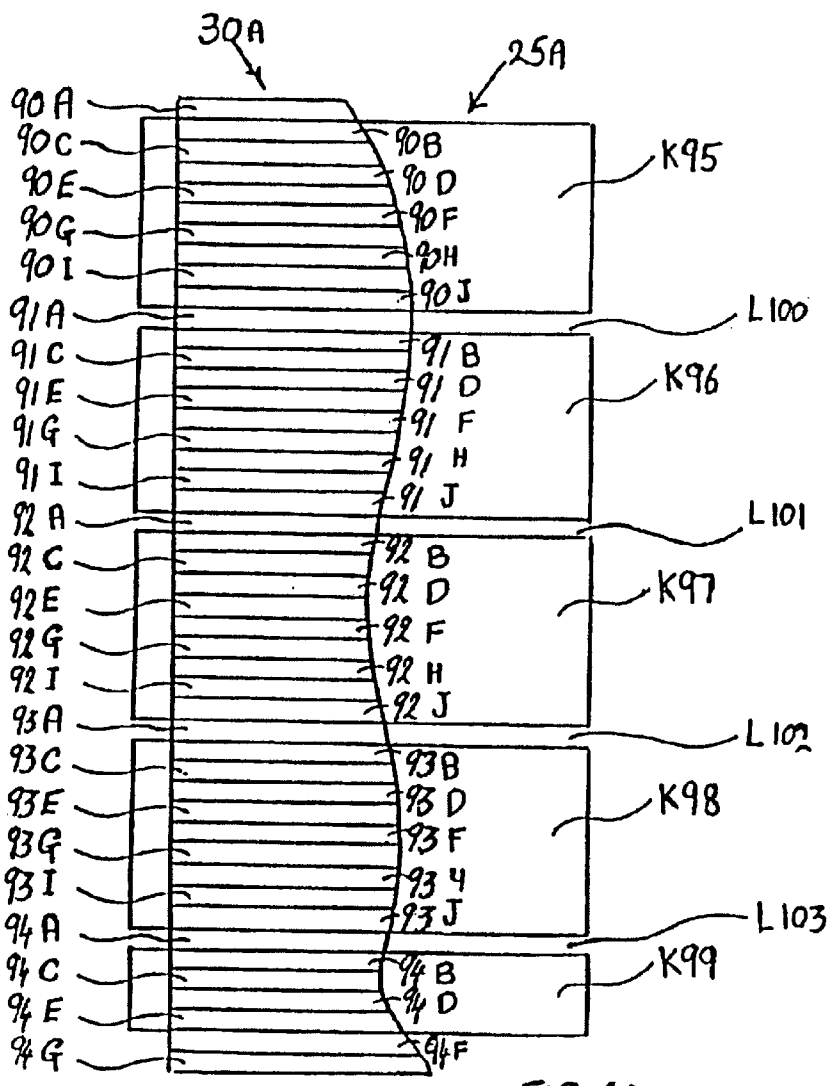
FIGS. 10A and 10B show an image grid and a masking grid respectively having image strips and window strips of the same width.
Figure 10A:
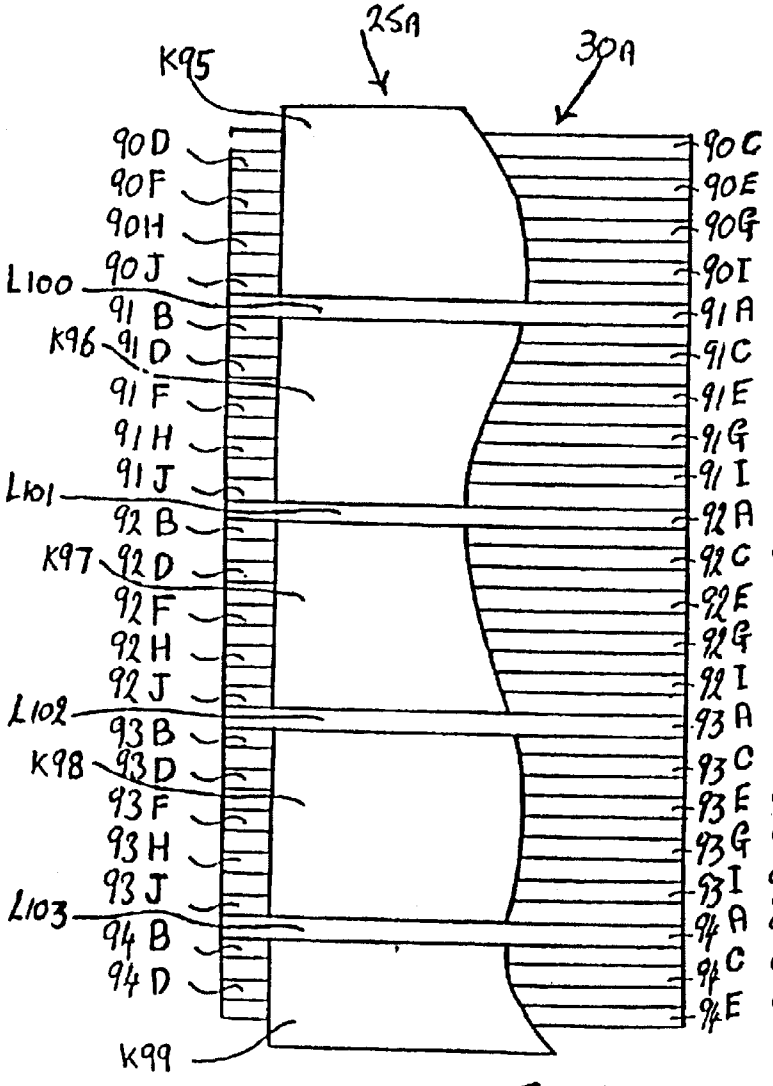

Referring to FIG. 10A, each image strip 90C to 94E of the image grid 30A is 0.20 mm wide, and since image strips B to J of each set 90 to 94 are obscured by opaque strips K95 to K99 of the masking grid, which themselves are each 1.80 mm wide, only image strips A90 to A94 are visible through transparent strips L100 to L103 which are themselves 0.20 mm wide. A similar situation applies with regard to FIG. 10B where the image grid 30A and the masking grid 25A are identical to those in FIG. 10A but the image grid is on top of the masking grid 25A rather than on top of it.

Each of the 0.20 mm wide image strips 90C to 94E shown in FIG. 10A, or 90A to 94G shown in FIG. 10B, will then briefly appear twice adjacent to the corresponding transparent strips 100L to 103L of the masking grid 25A, once as the masking grid 25A or the image grid 30A rises, and then once as it falls.

Using the cam 104 with the image and masking grids of FIGS. 10A or 10B, if the cam 104 revolves once every forty seconds, the resulting animation sequence will be five seconds long from the first image to the tenth image and back to the first image again. This results from each sequence being one eighth of the time taken for a full revolution of the cam 104.

Figure 11:
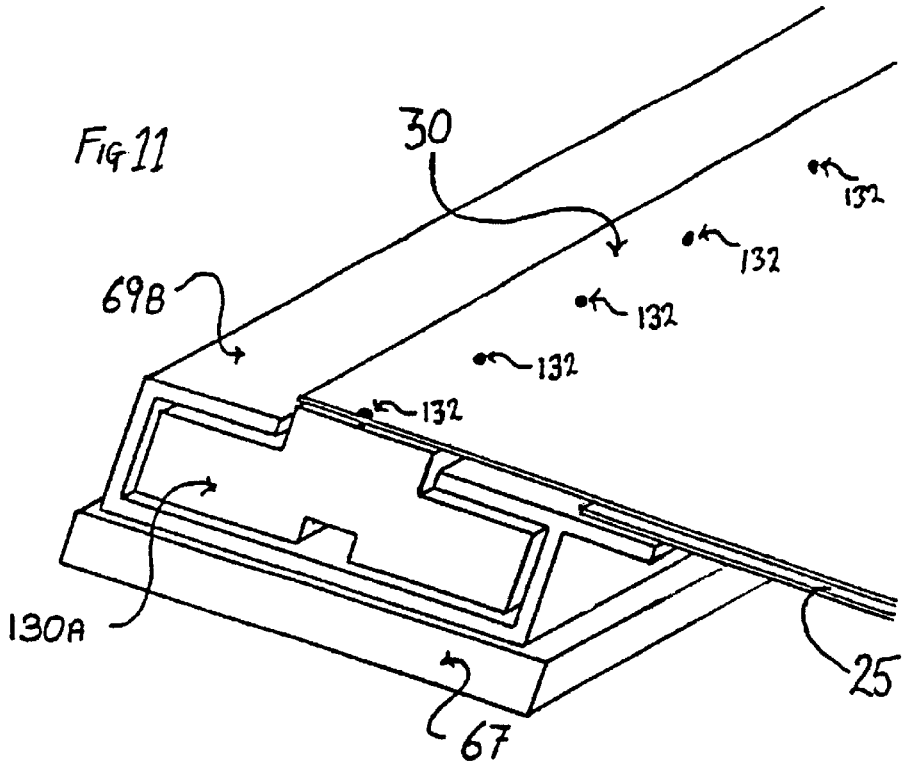
FIG. 11 is a perspective view of a portion of a slider arrangement of a yet further embodiment.

As an alternative to the compression and slide system described with reference to FIGS. 5 and 6, FIG. 11 shows the clamping bar of FIG. 5 replaced by a slide housing 69B to which a static grid is attached, for example a masking grid 25. The bearings 130 of FIG. 5 are replaced by a self-lubricating plastic slider 130A to which the moveable grid 30 is attached, the slide housing 69B being fixed to the angled section 67.

Studs 132 fixed to and projecting from the upper surface of the self-lubricating plastic slider 130A correspond with accurately punched holes along the side edges of the moveable grid 30 so that when the moveable grid 30 is held in position by the projecting studs 132, it is compressed into the static grid 25 when the static grid 25 and the moveable grid 30 are concave, the compressive effect being achieved by ensuring the distance between the punched holes along one side of the grid and those along the other side is greater than it would be if these punched holes were positioned to hold the grid so that it lay along the curve of the other fixed grid without being compressed into the fixed grid. However, if the grids 25 and 30 are convex, the static grid 25 is compressed into the moveable grid 30, again by ensuring the distance between the fixings holding the static grid in position are appropriate to ensure the compressive force is effective.

Figure 12:
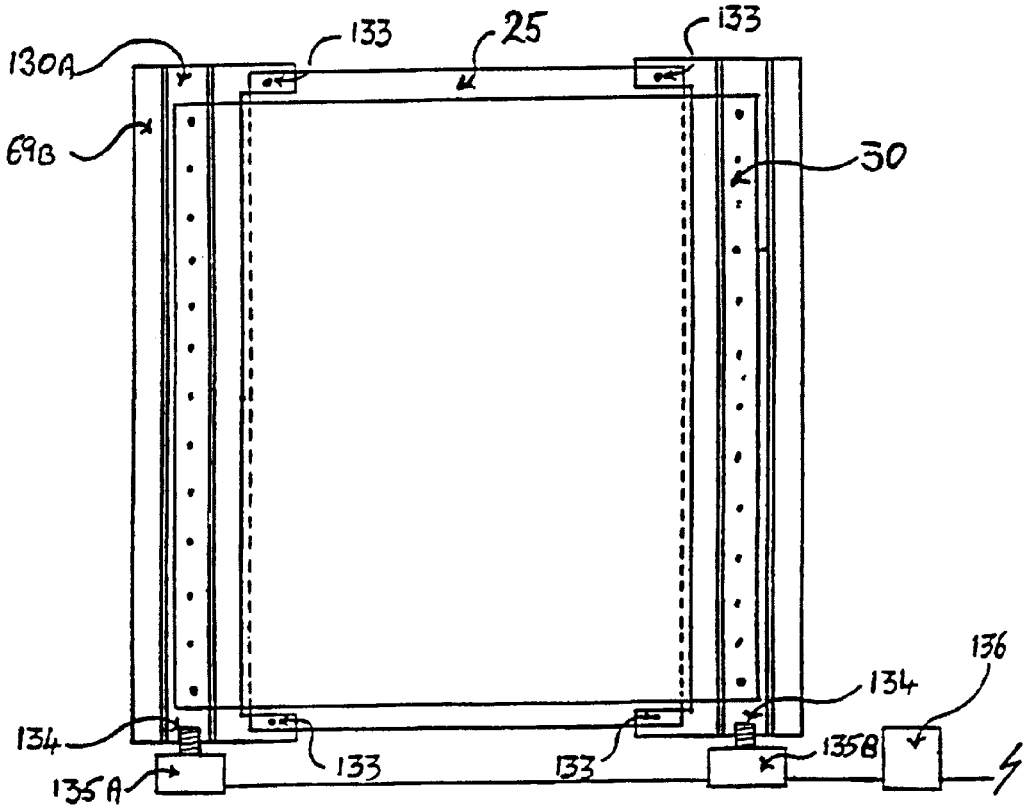
FIG. 12 is a front view of the embodiment of FIG. 11.

Referring to FIG. 12, the static grid 25 is longer than the moveable grid 30, thereby allowing the static grid 25 to be attached to the slide housing 69B at points 133 without blocking movement of the moveable grid 30. To provide a firm backing to facilitate wiping of the grids 30 and 25, and to remove air pockets between them, a sheet of clear or semi-opaque material, say 3 mm thick, can be compressed between the two slide housings 69B to create a rigid curve matching that of the grids 30 and 25. However, great care should be taken to ensure that the changing curvature of the clear or semi-opaque material caused by expansion and contraction produced by temperature changes does not affect movement of the moveable grid 30, for example by pushing the static grid 25 against the moveable grid 30 with such force that the moveable grid 30 is jammed against the static grid 25 and thus cannot move.

The upper surface of the self-lubricating plastic slider 130A to which the projecting studs 132 are attached projects outwardly of the slide housing 69B, for example by 300 $\mu$m if the static grid 25 attached to the extended upper surface of the slide housing 69B is 250 $\mu$m thick.

For greater accuracy of movement of the moveable grid 30, the self-lubricating slider 130A can be replaced by an arrangement of linear or roller bearings at each end of both slide housings 69B, the linear or roller bearing at one end of the slide housing being joined to the other at the other end of the slide housing by an aluminum bar to which projecting studs 132 are fixed corresponding to the holes punched along the side edges of the moveable grid 30.

The moveable grid 30 can then be moved by spindles 134 controlled by linear stepper drive mechanisms 135A and 135B fixed to one end of each of the self-lubricating sliders 130A. The drive mechanisms 135A and 135B are controlled by a control board 136, and they can be arranged to drive the spindles 134 repeatedly up and down in appropriate increments, for example four increments of 0.40 mm in the case of a quadruple image system, three increments of 0.50 mm in the case of a triple image system, and a single up and down movement of 2.00 mm in the case of an animated system incorporating ten images each made up of image strips 0.20 mm wide.

The self-lubricating slider 130A shown in FIG. 11 is moved by the linear drive mechanisms 135A and 135B, and the slide housing 69B remains static. However, with the alternative profiles of slide housing 69B and self-lubricating slider 130B shown in FIGS. 13A and 13B, the slide housing 69B is moveable by the linear drive mechanisms 135A and 135B and the slider 130B remains static. The slide housings 69B are attached by brackets 137 to the spindles 134 which are driven by the linear drive mechanisms 135A and 135B, the self-lubricating slide 130B being fixed to the angled section 67.

The window strips of the masking grid will then usually need to be centered along the center lines of the image strips of the image grid, and this can be effected using the linear drive mechanisms 135A and 135B to move the associated spindles 134 sufficiently to achieve registration. If the image strips of the image grid are not parallel with the window grids of the masking grid, the drive mechanism on one side of the moveable grid is then adjusted accordingly. Any vertical movement required to bring about registration of image and window grids which are parallel but not otherwise in registration can then be effected by moving both sides of the moveable grid by the same amount using the drive mechanisms 135A and 135B.

Movement of the moveable grid relative to the static grid to display images can then be effected using equal steps produced by the linear drive mechanisms 135A and 135B under the control of the control board 136. Extra steps can be incorporated into the drive sequence to take account of back-lash in the drive mechanism that can occur when the driving force changes direction.

Figure 13A:
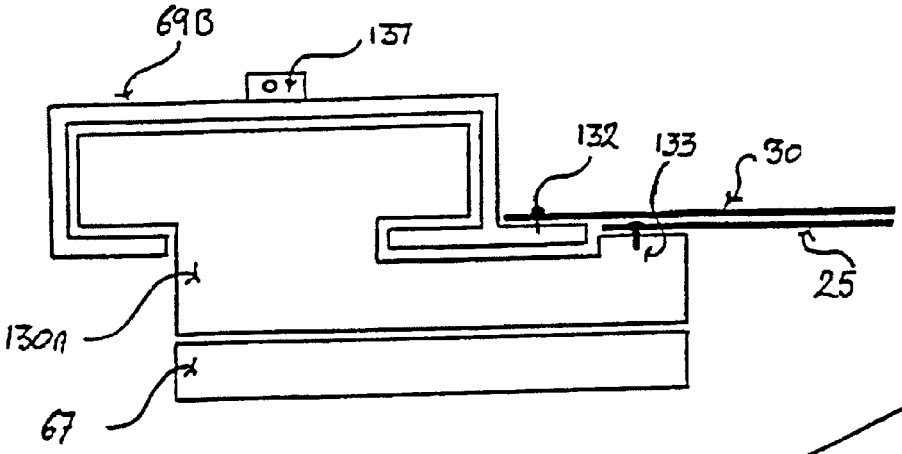
FIG. 13A is a section through an alternative slider arrangement to that shown in FIG. 11.
Figure 13B:
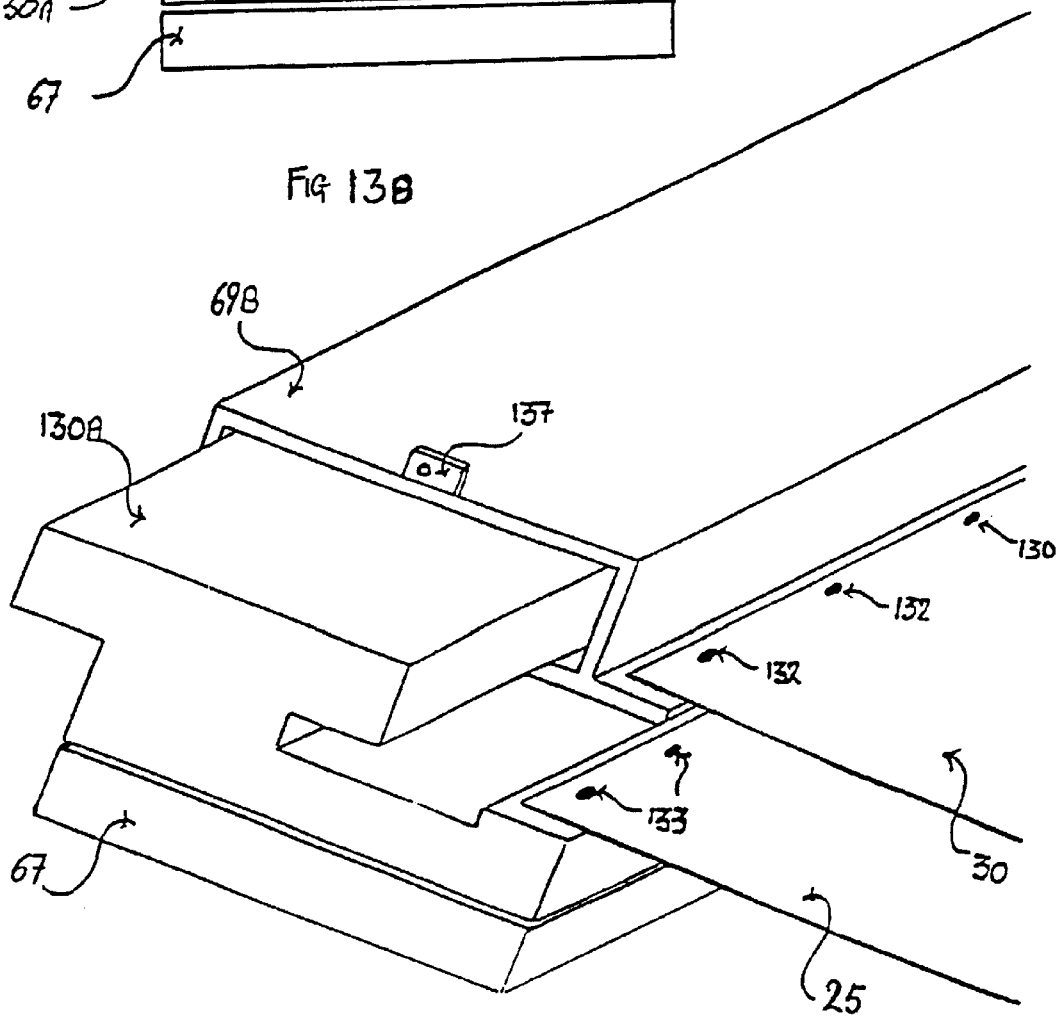
FIG. 13B is a perspective view of the slider arrangement of FIG. 13A.

FIGS. 13A and 13B show an alternative slide housing 69B and self-lubricating slider 130A, the slide housing 69B being attached to the linear drive mechanism 135 using brackets 137 attached to the spindles 134, and the self-lubricating slider 130A being fixed to the angled section 67.

Figure 14A:
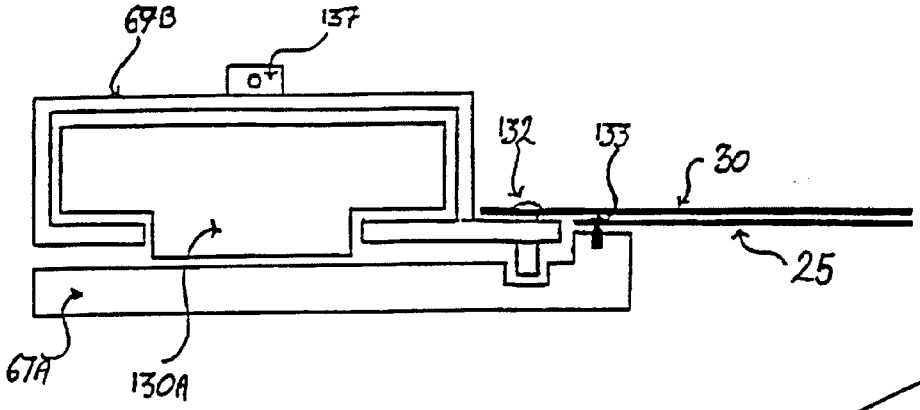
FIG. 14A is a section through a further alternative slider arrangement to that shown in FIG. 13A.
Figure 14B:
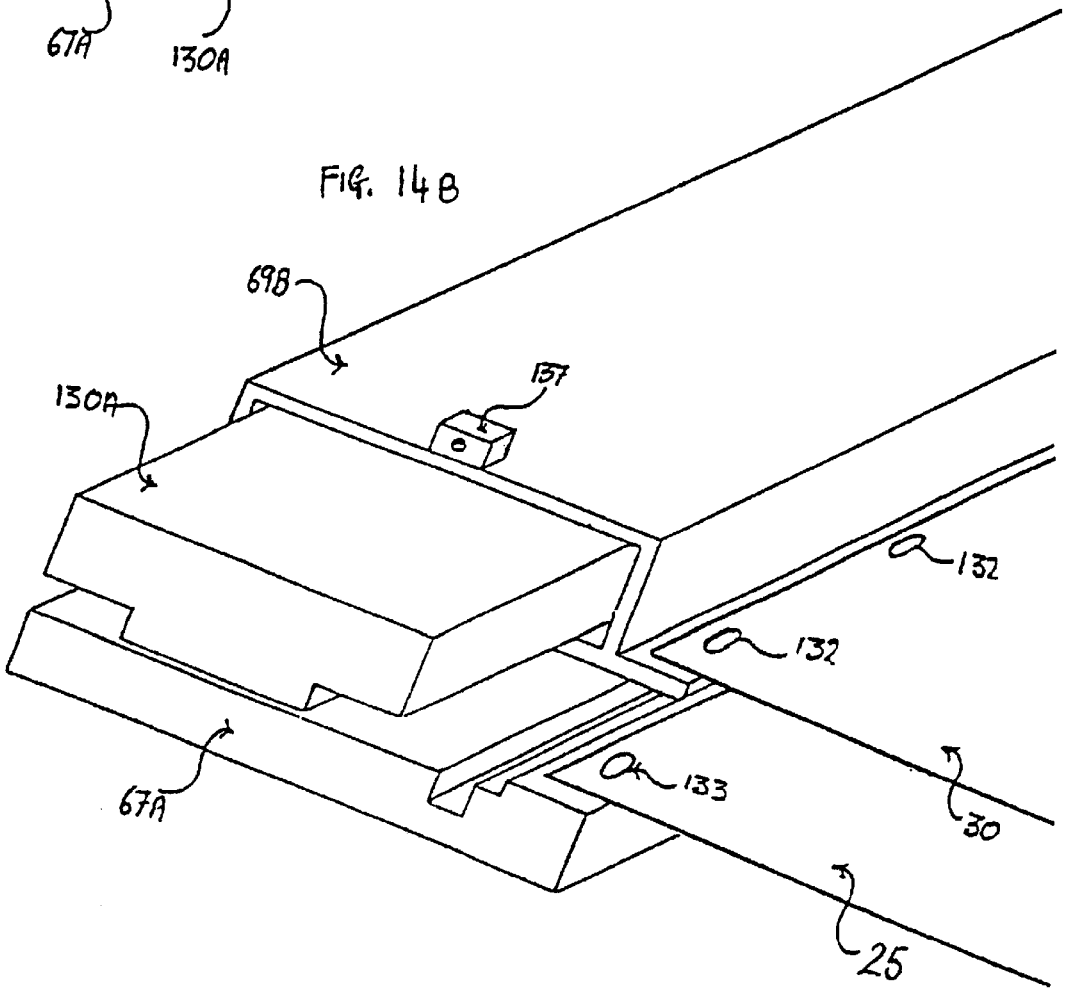
FIG. 14B is a perspective view of the slider arrangement of FIG. 14A.

FIGS. 14A and 14B show a yet further alternative arrangement of slide housing 69B and self-lubricating slider 130A which is similar to that of FIGS. 13A and 13B but has different profiles for the slide housing 69B and the self-lubricating slider 130A, in particular to provide a groove in the angled section 67A in which a portion of the studs 132 extending below the slide housing 69A can run freely.

Figure 15:
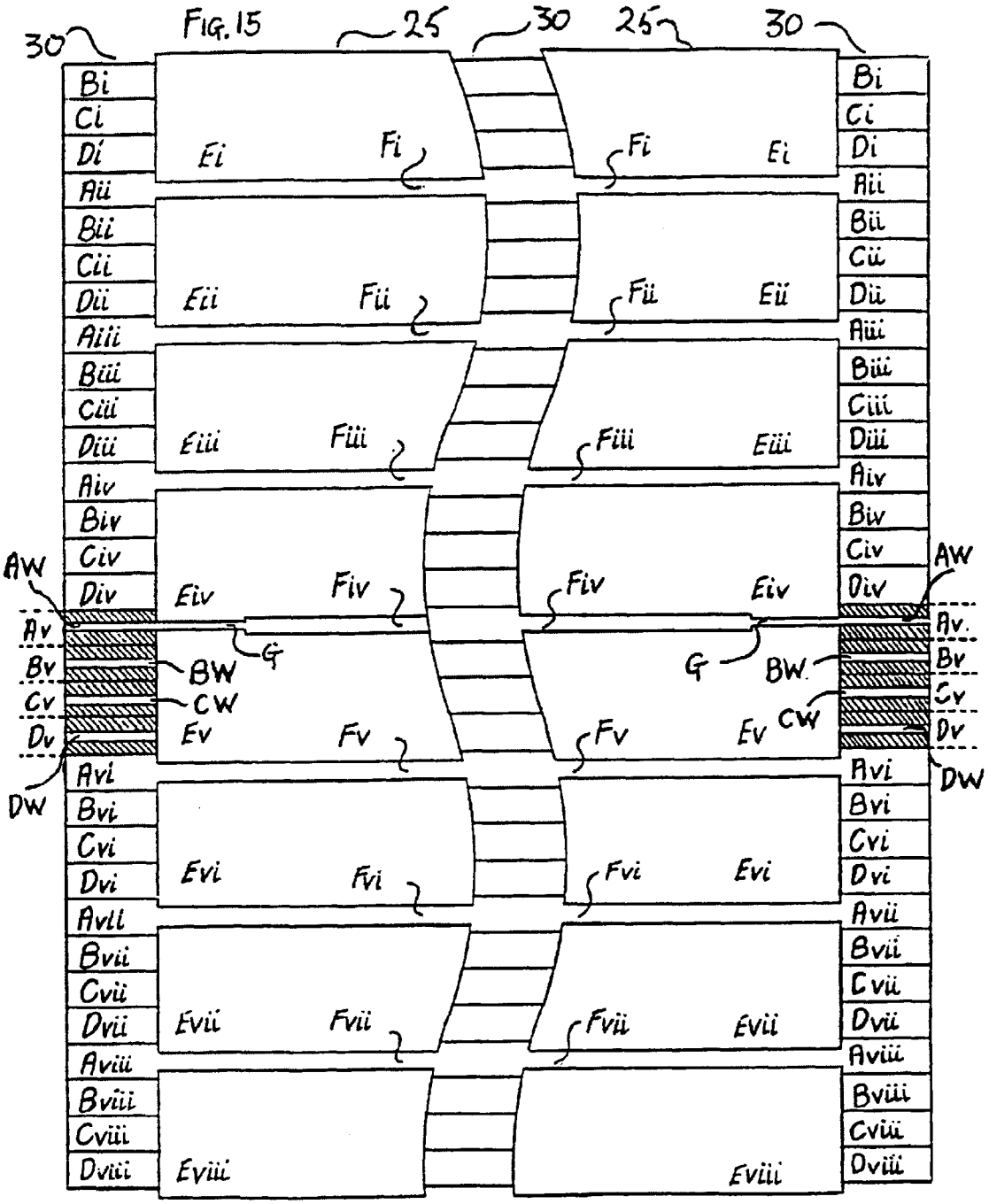
FIG. 15 shows a masking grid over an image grid which include means for obtaining registration between the grids.

FIG. 15 shows an arrangement of a masking grid 25 overlaying an image grid 30 which include means for obtaining registration between the window strips of the masking grid 25 and the individual image strips of the image grid 30, the masking grid 25 having been moved to the left to show the image strips below.

The masking grid 25 shown in FIG. 15 has opaque strips Ei to Evii and window strips Fi to Fvii, and the image grid 30 has image strips Bi to Dviii.

The window strip Fiv, which is between adjacent masking strips Eiv and Ev, has a portion G near to the edge of the masking grid which is narrower than at its center and narrower than the window strips between the other masking strips.

An edge portion of the image grid 30 beneath the masking grid 25 has four window strips AW, BW, CW and DW centered along the center lines of four adjacent image strips AV to AD, these being positioned so that the narrow portion of the window strip Fiv coincides with the windows AW, BW, CW and DW of the four adjacent image strips AV to DV when the respective sets of image strips A to D are in registration with the window strips Fi to Fvii of the masking grid 25. Registration of the window strips Fi to Fvii of the masking grid 25 with the respective images of the image grid 30 can then be effected using a photocell to detect light passing through the narrow windows in both grids, and this can also be used to control the relative upward and downward movement of these grids during normal operation of the system.

The use of a photocell with narrow window strips at the edges of the masking and image grids to control the linear drive mechanisms 135A and 135B can enable a particularly accurate positioning of these grids relative to each other and it can be used to control the number of the steps taken between successive images to compensate for backlash in the drive mechanism or for minor dimensional inaccuracies in the grids.

As will be appreciated by those skilled in the art, registration of the image grid with the masking grid, both vertically and, to ensure the image strips are parallel to the window strips, horizontally, can be effected using arrangements of photocells, for example which respond to positional information determined from the opposite edges of the image and the masking grid such as have been described for the grids with reference to FIG. 15.

Poster display systems in accordance with the present invention can be used in a wide variety of applications, for example:

1. as retail outlet window displays, the system in accordance with the invention being suspended against the window of the retail outlet and relying on external, natural ambient light to backlight the poster or on electric illumination directed from inside the retail outlet which backlights the poster images so that they can be viewed from outside the retail outlet;
2. as illuminated display case accessories in which the display system is positioned within the case to be backlit by a light source in the case;
3. as edge-lit display accessories in which the display system is positioned against the front face of an edge-lit display;
4. as controllable partition systems in which,the partition can be transparent or opaque, the image grid itself possibly being in the form of a masking grid to make the partition opaque when the window strips of the masking grid are obscured by what amount to masking strips of the image grid; and
5. as a vending machine accessory in which the display system is positioned within the machine so that is can be seen by potential users.

What is claimed is:

1. A poster display system for displaying a plurality of different images, the system comprising (a) an image grid carrying a first set of image strips comprising a multiplicity of first strips spaced apart from one another and presenting different regions of a first image, and a second set of image strips comprising a multiplicity of second strips spaced apart from one another and presenting different regions of a second image, said second strips being distributed over the grid between the said first strips;

(b) a masking grid adjacent to the image grid and carrying a set of masking strips comprising a multiplicity of masking strips spaced apart from one another and a set of window strips comprising a multiplicity of window strips spaced apart from one another, said window strips being distributed over the masking grid between said masking strips;

(c) a mounting system for mounting the image grid and the masking grid for movement relative to one another;

(d) drive means for producing relative movement between the image grid and the masking grid between a first display position, in which said window strips are aligned with said first image strips and said second image strips are obscured by said masking strips, and a second display position, in which said window strips are aligned with said second image strips and said first image strips are obscured by said masking strips; and (e) compression means for urging opposite edge portions of the image grid and of the masking grid towards each other whereby the image grid and the masking grid become curved and the image grid and the masking grid are brought into intimate contact with one another under pressure.

2. A system according to claim 1, wherein the compression means applies a further force to opposing edge portions of the masking grid or to opposing edge portions of the image grid whereby the masking grid and the image grid become curved and in intimate contact with each other under greater pressure.

3. A system according to claim 1, wherein the image grid and the masking grid are curved by the compression means so that they are convex as viewed from the front of the system.

4. A system according to claim 1, wherein the image grid and the masking grid are curved by the compression means so that they are concave as viewed from the front of the system.

5. A system according to claim 1, wherein the image grid is in front of the masking grid as seen by a viewer of the system.

6. A system according to claim 1, wherein the image grid is behind the masking grid as seen by a viewer of the system.

7. A system according to claim 1, wherein the opposite edge portions of the image grid or the masking grid are attached to slides for facilitating relative movement between the image grid and the masking grid.

8. A system according to claim 7, wherein the slides comprise linear slides within a slide housing.

9. A system according to claim 8, wherein the image grid or the masking grid is attached to the linear slides and the other of said grids is attached to the slide housing.

10. A system according to claim 1, wherein the drive means comprises at least one stepper motor.

11. A system according to claim 10, wherein the drive means comprises two stepper motors each of which being arranged to move opposite edges of either the image grid or the masking grid to produce said relative movement.

12. A system according to claim 11, wherein the stepper motors can be actuated moved separately or together to effect registration between the image grid and the masking grid.

13. A system according to claim 11, wherein the stepper motors can be actuated together to effect changing of the images.

14. A system according to claim 1, wherein the image grid includes more than two images.

15. A system according to claim 1, wherein the image grid includes sufficiently large number of images whereby operation of the system produces the effect of animation.

16. A system according to claim 1, wherein the image strips of the image grid are of substantially the same width as the window strips of the masking grid.

17. A system according to claim 1, including at least one optical sensor for controlling the drive means to effect registration of the window strips of the masking grid with image strips of respective images on the image grid.

* * * * *